US006071132A

United States Patent [19]

Cook

[11] Patent Number: 6,071,132

[45] Date of Patent: Jun. 6, 2000

[54] ELECTRICAL RECEPTACLE QUICK CONNECT FOR APPLIANCES

[76] Inventor: Jesse J. Cook, 1950 S. Ocean Blvd. #312, Pompano Beach, Fla. 33062

[21] Appl. No.: 09/099,908

[22] Filed: Jun. 18, 1998

[51] Int. Cl.[7] ..... H01R 4/66

[52] U.S. Cl. ..... 439/106; 439/564; 312/228

[58] Field of Search ..... 439/106, 107, 439/562; 361/687; 312/228, 223.6

[56] References Cited

U.S. PATENT DOCUMENTS

| | | | |
|---|---|---|---|
| 3,862,786 | 1/1975 | Brezosky | 312/228 |
| 5,104,333 | 4/1992 | Hatagishi et al. | 439/564 |
| 5,748,444 | 5/1998 | Honda et al. | 361/687 |

*Primary Examiner*—Gary F. Paumen
*Assistant Examiner*—Briggitte Hammond

[57] ABSTRACT

An electrical receptacle quick connect for appliances including a rectangular housing secured within a rear panel of an appliance. The housing has a peripheral flange disposed around an outer edge thereof. The peripheral flange has a pair of apertures through upper and lower portions thereof. The apertures receive threaded screws therethrough for securing the housing to the appliance. A three prong plug extends outwardly of the housing. The three prong plug is adapted for coupling with an appliance extension cord whereby the appliance extension cord couples with an electrical outlet. The three prong plug has wiring extending outwardly therefrom. The wiring includes a pair of wires for coupling with a motor winding of the appliance. The wiring includes a ground wire.

2 Claims, 2 Drawing Sheets

ELECTRICAL RECEPTACLE QUICK CONNECT FOR APPLIANCES

BACKGROUND OF THE INVENTION

1. Field of the Invention

The present invention relates to an electrical receptacle quick connect for appliances and more particularly pertains to allowing for connection of appliances to an electrical outlet with an electrical receptacle quick connect for appliances.

2. Description of the Prior Art

The use of electrical plug receptacles is known in the prior art. More specifically, electrical plug receptacles heretofore devised and utilized for the purpose of receiving electric plugs are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,025,490 to Hicks; U.S. Pat. No. 2,850,244 to James et al.; U.S. Pat. No. 3,541,493 to Morrill; and U.S. Pat. No. 5,244,411 to Schinke et al.

While these devices fulfill their respective, particular objective and requirements, the aforementioned patents do not describe an electrical receptacle quick connect for appliances for allowing for connection of appliances to an electrical outlet.

In this respect, the electrical receptacle quick connect for appliances according to the present invention substantially departs from the conventional concepts and designs of the prior art, and in doing so provides an apparatus primarily developed for the purpose of allowing for connection of appliances to an electrical outlet.

Therefore, it can be appreciated that there exists a continuing need for new and improved electrical receptacle quick connect for appliances which can be used for allowing for connection of appliances to an electrical outlet. In this regard, the present invention substantially fulfills this need.

SUMMARY OF THE INVENTION

In the view of the foregoing disadvantages inherent in the known types of electrical plug receptacles now present in the prior art, the present invention provides an improved electrical receptacle quick connect for appliances. As such, the general purpose of the present invention, which will be described subsequently in greater detail, is to provide a new and improved electrical receptacle quick connect for appliances and method which has all the advantages of the prior art and none of the disadvantages.

To attain this, the present invention essentially comprises a rectangular housing secured within a rear panel of an appliance. The housing has a peripheral flange disposed around an outer edge thereof. The peripheral flange has a pair of apertures through upper and lower portions thereof. The apertures receive threaded screws therethrough for securing the housing to the appliance. A three prong plug extends outwardly of the housing. The three prong plug is adapted for coupling with an appliance extension cord whereby the appliance extension cord couples with an electrical outlet. The three prong plug has wiring extending outwardly therefrom. The wiring includes a pair of wires for coupling with a motor windings of the appliance. The wiring includes a ground wire.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electrical receptacle quick connect for appliances which has all the advantages of the prior art electrical plug receptacles and none of the disadvantages.

It is another object of the present invention to provide a new and improved electrical receptacle quick connect for appliances which may be easily and efficiently manufactured and marketed.

It is a further object of the present invention to provide a new and improved electrical receptacle quick connect for appliances which is of durable and reliable construction.

An even further object of the present invention is to provide a new and improved electrical receptacle quick connect for appliances which is susceptible of a low cost of manufacture with regard to both materials and labor, and which accordingly is then susceptible of low prices of sale to the consuming public, thereby making such an electrical receptacle quick connect for appliances economically available to the buying public.

Even still another object of the present invention is to provide a new and improved electrical receptacle quick connect for appliances for allowing for connection of appliances to an electrical outlet.

Lastly, it is an object of the present invention to provide a new and improved electrical receptacle quick connect for appliances including a rectangular housing secured within a rear panel of an appliance. The housing has a peripheral flange disposed around an outer edge thereof. The peripheral flange has a pair of apertures through upper and lower portions thereof. The apertures receive threaded screws therethrough for securing the housing to the appliance. A three prong plug extends outwardly of the housing. The three prong plug is adapted for coupling with an appliance extension cord whereby the appliance extension cord couples with an electrical outlet. The three prong plug has wiring extending outwardly therefrom. The wiring includes a pair of wires for coupling with a motor windings of the appliance. The wiring includes a ground wire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
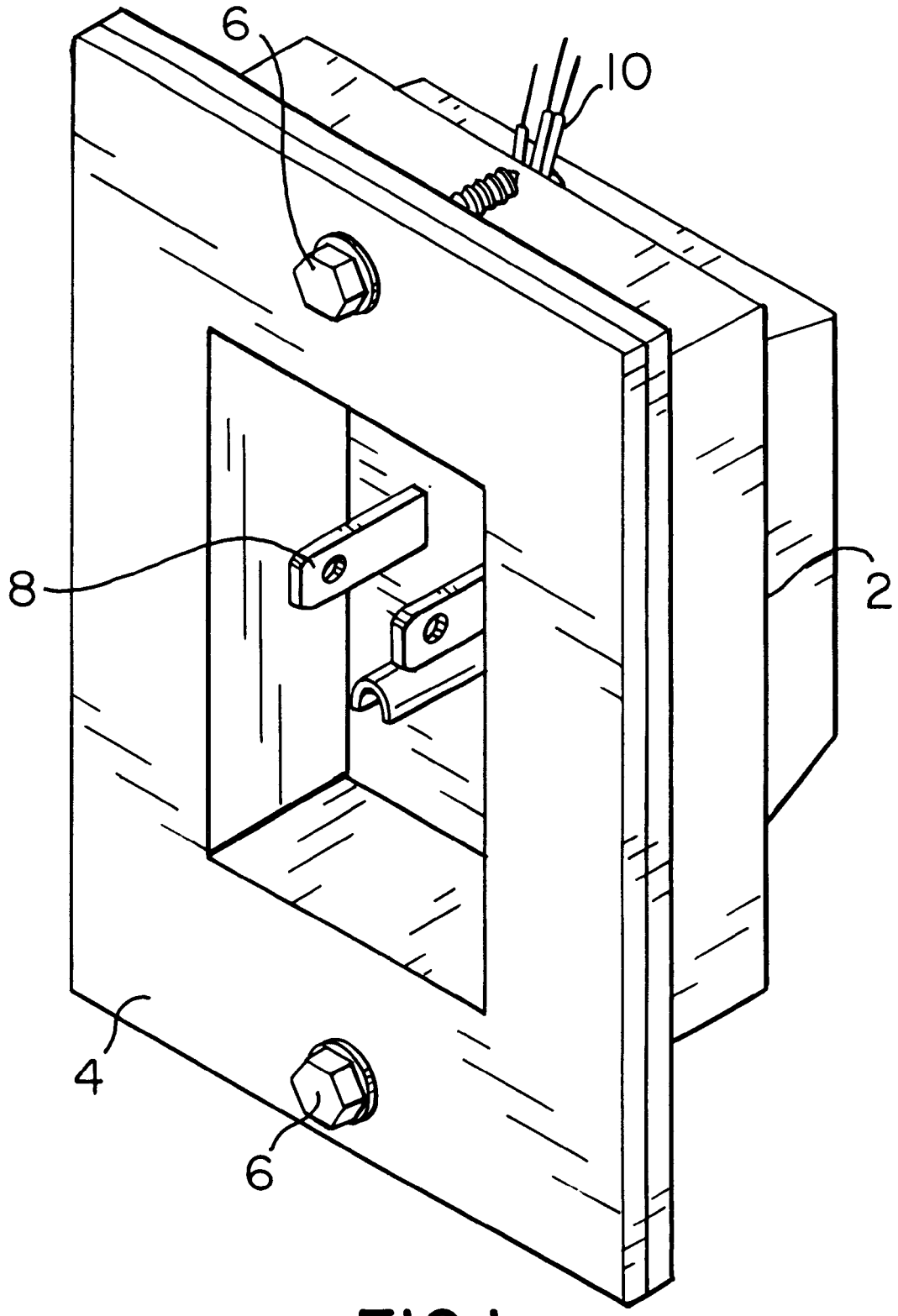
FIG. 1 is a perspective view of the preferred embodiment of the electrical receptacle quick connect for appliances constructed in accordance with the principles of the present invention.
Figure 2:
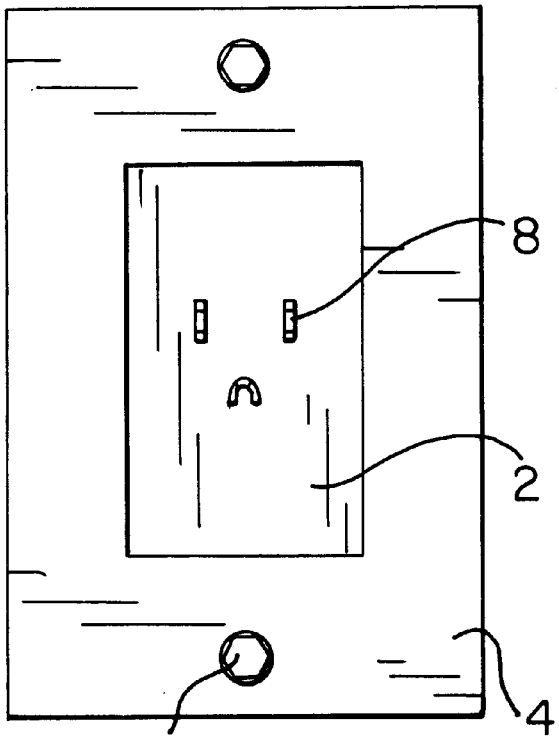
FIG. 2 is a front elevation view of the present invention.
Figure 3:
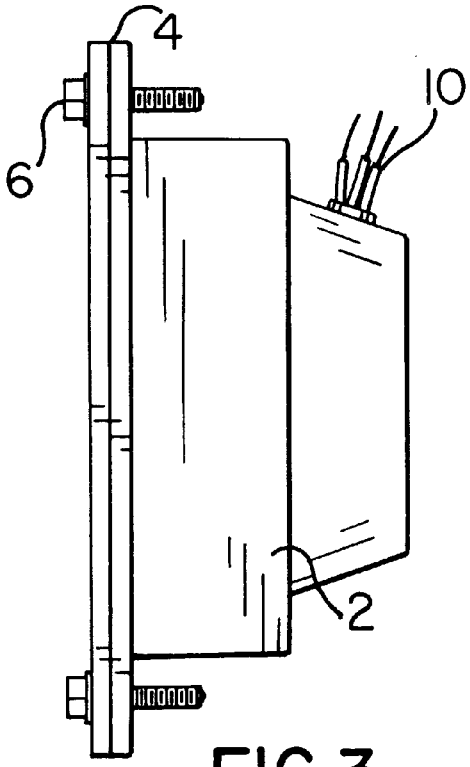
FIG. 3 is side elevation view of the present invention.

With reference now to the drawings, and in particular, to FIGS. 1 through 3 thereof, the preferred embodiment of the new and improved electrical receptacle quick connect for appliances embodying the principles and concepts of the present invention will be described.

Specifically, it will be noted in the various Figures that the device relates to a electrical receptacle quick connect for appliances for allowing for connection of appliances to an electrical outlet. In its broadest context, the device consists of a rectangular housing and a three prong plug. Such components are individually configured and correlated with respect to each other so as to attain the desired objective.

The rectangular housing 2 secured within a rear panel of an appliance. The housing 2 has a peripheral flange 4 disposed around an outer edge thereof. The peripheral flange 4 has a pair of apertures through upper and lower portions thereof. The apertures receive threaded screws 6 therethrough for securing the housing 2 to the appliance.

A three prong plug 8 extends outwardly of the housing 2. The three prong plug 8 is adapted for coupling with an appliance extension cord whereby the appliance extension cord couples with an electrical outlet. The three prong plug 8 has wiring 10 extending outwardly therefrom. The wiring 10 includes a pair of wires for coupling with a motor winding of the appliance. The wiring 10 includes a ground wire.

The present invention would act as a quick connect to allow for appliances, such as dishwashers and garbage disposals to be connected without need of an electrician. The present invention could be added to existing appliances to allow the average layman to connect their own appliances. The three prong plug 8 allows for connection to a standard appliance electric cord. The appliance electric cord can then be plugged into an electrical outlet to power the appliance for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An electrical receptacle quick connect on a dishwasher for allowing for connection thereof to an electrical outlet comprising, in combination:

a housing secured within a rear panel of a dishwasher, the housing having a peripheral flange disposed around an outer edge thereof, the peripheral flange having a pair of apertures through upper and lower portions thereof, the apertures receiving threaded screws therethrough which secure the housing to the dishwasher;

a three prong plug extending outwardly of the housing, the three prong plug adapted for coupling with an appliance extension cord whereby the appliance extension cord couples with an electrical outlet, the three prong plug having wiring extending outwardly therefrom, the wiring including a pair of wires coupled to a motor winding of the dishwasher, the wiring including a ground wire.

2. An electrical receptacle quick connect on a garbage disposal for allowing for connection thereof to an electrical outlet comprising, in combination:

a housing secured within a rear panel of a garbage disposal, the housing having a peripheral flange disposed around an outer edge thereof, the peripheral flange having a pair of apertures through upper and lower portions thereof, the apertures receiving threaded screws therethrough for securing the housing to the appliance;

a three prong plug extending outwardly of the housing, the three prong plug adapted for coupling with an appliance extension cord whereby the appliance extension cord couples with an electrical outlet, the three prong plug having wiring extending outwardly therefrom, the wiring including a pair of wires for coupling with a motor winding of the appliance, the wiring including a ground wire.

* * * * *